United States Patent [19]

Bongard et al.

[11] Patent Number: 4,596,985

[45] Date of Patent: Jun. 24, 1986

[54] RADIO-CONTROLLED LOCK METHOD WITH AUTOMATIC CODE CHANGE

[75] Inventors: Wilhelm Bongard, Moers; Helmut Moser; Karl Militzer, both of Heilbronn-Neckargartach, all of Fed. Rep. of Germany

[73] Assignees: Kiekert GmbH & Co. Kommanditgesellschaft; Telefunken Electronic GmbH, both of Heilbronn, Fed. Rep. of Germany

[21] Appl. No.: 555,471

[22] Filed: Nov. 28, 1983

[30] Foreign Application Priority Data

Nov. 27, 1982 [DE] Fed. Rep. of Germany ..... 3244049

[51] Int. Cl.[4] ..... G08C 19/00

[52] U.S. Cl. ..... 340/825.69; 340/825.31; 340/825.34; 340/825.72

[58] Field of Search ..... 340/825.69, 825.31, 340/825.34, 572, 825.72; 361/171, 172

[56] References Cited

U.S. PATENT DOCUMENTS 3,821,704 6/1974 Sabsay ..... 340/825.31 X
3,891,980 6/1975 Lewis et al. ..... 340/572
3,906,447 9/1975 Crafton ..... 340/825.31 X
3,919,528 11/1975 Cooper et al. ..... 340/825.31 X
3,926,021 12/1975 Genest et al. ..... 340/825.31 X
4,157,534 6/1979 Schachter ..... 340/825.31

FOREIGN PATENT DOCUMENTS 2824421 12/1979 Fed. Rep. of Germany .

*Primary Examiner*—Ulysses Weldon
*Attorney, Agent, or Firm*—Karl F. Ross; Herbert Dubno

[57] ABSTRACT

A remote-control lock system has a transmitter that can be set to emit any one of a succession of differently coded signals, a receiver that can be set to respond to any one of the succession of signals, and a lock operable by the receiver when it receives the signal it is set to. Initially the transmitter is set to emit a predetermined one of the succession of signals and the receiver is set to respond to the predetermined one of the signals. Thereafter, after each emission by the transmitter and reception by the receiver, the transmitter and receiver are reset to the next of the signals in the succession except after the last signal of the succession has been emitted and received in which case the transmitter and receiver are reset to the first of the succession of signals. Thus each actuation of the transmitter change the code that will open the lock.

6 Claims, 1 Drawing Figure

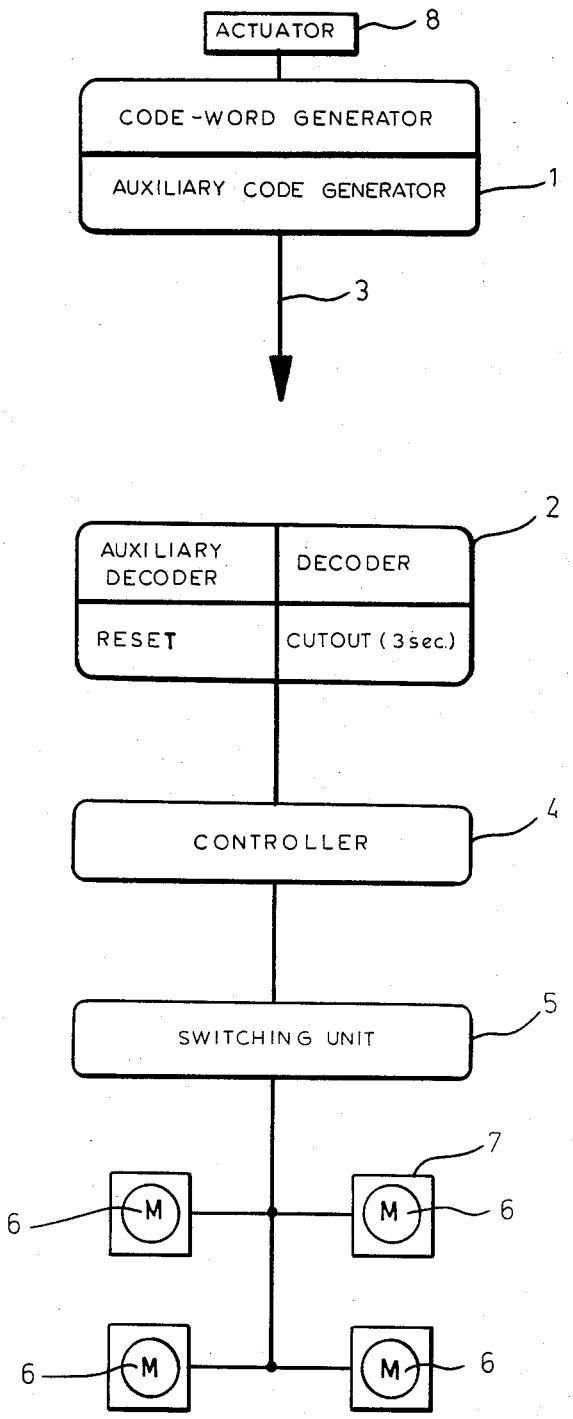
ACTUATOR
8
CODE-WORD GENERATOR
AUXILIARY CODE GENERATOR
1
3
2
AUXILIARY DECODER
DECODER
RESET
CUTOUT (3sec.)
CONTROLLER
4
SWITCHING UNIT
5
7
6
M
M
6
6
M
M
6

RADIO-CONTROLLED LOCK METHOD WITH AUTOMATIC CODE CHANGE

FIELD OF THE INVENTION

The present invention relates to a remote-control lock system. More particularly this invention concerns a remote-control lock and method of operating same that is particularly useful in a motor vehicle.

BACKGROUND OF THE INVENTION

A remote-control lock system of the type used to unlock the doors or disarm the burglar alarm of a motor vehicle, or to open a garage door or the like basically comprises a transmitter, a receiver, and a mechanical lock. The transmitter emits a radio-frequency, ultrasonic, or even light signal that the receiver is tuned to. When this signal is received, the receiver actuates the lock, either locking or unlocking it, and can also institute other action, such as starting up an actuator for opening or closing a door.

In the simplest systems the transmitter emits a signal in a particular frequency band and the receiver is tuned to this band only. A normally unused band is used to reduce the likelihood of accidental actuation of the lock.

This type of arrangement is particularly susceptible of malfunction, as the particular signal can sometimes be generated accidentally, for instance by so-called dirty portable transceivers or malfunctioning equipment. In addition it is relatively easy for a person vaguely familiar with the lock system to generate a scanning signal which will eventually traverse the band the receiver is tuned to and actuate it. More sophisticated procedures can involve monitoring the location with the lock system in question with a scanning receiver to discover the wave length that is used. The equipment and knowledge to do this is well within the scope of the average industrial spy, burglar, or the like.

As a result recourse is now normally had to coded signals. Such signals are typically numerically coded, normally also in binary fashion as a sequence of short and long pulses, of pulses of two different signals, or of particularly modulated signals. Both the transmitter and receiver are provided with sets of dip switches that can be set by the user at any of the possible codes.

The password procedures for imparting a certain signature or envelope to the signal and creating a so-called code word are well known in the art, as are the systems for receiving, reading, and reacting to it. Using only, for instance, an eight-bit binary-coded signal it is possible to obtain 256 different codings, making accidental generation of the particular code at the particular frequency statistically unlikely. If a six- or eight-digit decimally coded signal is employed, the selection of possible code words becomes vast.

Unfortunately it is still within the ken of a person skilled in electronics and allied fields to clandestinely monitor the coded signal when it is transmitted. Later at the simplest a recording of it can be transmitted to operate the lock, or a transmitter can be constructed to produce the desired code.

OBJECTS OF THE INVENTION

It is therefore an object of the present invention to provide an improved lock system and method of operating same.

Another object is the provision of such a lock system and method of operating same which overcomes the above-given disadvantages, that is which cannot even be opened by a person who can monitor and reproduce a locking code.

SUMMARY OF THE INVENTION

A remote-control lock system has a transmitter that can be set to emit any one of a succession of differently coded signals, a receiver that can be set to respond to any one of the succession of signals, and a lock operable by the receiver when it receives the signal it is set to. Initially according to this invention the transmitter is set to emit a predetermined one of the succession of signals and the receiver is set to respond to the predetermined one of the signals. Thereafter, after each emission by the transmitter and reception by the receiver, the transmitter and receiver are reset to the next of the signals in the succession except after the last signal of the succession has been emitted and received in which case the transmitter and receiver are reset to the first of the succession of signals.

Thus according to the invention the transmitter includes an encoder that can produce an unlocking signal that is constituted by any of a plurality of different code words, that is the transmitter can emit any of a succession of differently coded signals. This transmitter also includes a resetting unit that automatically advances the transmitter to the next signal of the progression each time it is actuated. When the last signal of the succession is emitted the transmitter is reset to the first of the succession, and the process can be repeated.

The receiver is complementarily constructed so that it can respond to any one of the signals, but is settable to respond only to one of them. A resetting unit in the receiver resets it to the next of the succession of signals each time a signal is successfully received, or to the first of the succession when the last signal of the succession was received. Thus the transmitter and receiver will be indexed synchronously through the succession of signals.

In this manner if a would-be thief or the like monitors the site and is able to receive and duplicate the coded unlocking signal, he or she will not be able to operate the lock, as this particular signal is not going to work again until the entire succession has been generated, which will not be for a long time with a large succession having $10^6$ to $10^9$ different code words that themselves follow a random or complex succession. In this manner it is possible to provided such lock systems on an entire series of cars with the likelihood of one transmitter opening another being statistically insignificant. If a code is used having $10^6$ to $10^9$ code words, it is possible to use only a portion of the code having 20 to 30 code words, thereby allowing the same equipment to be used while largely eliminating the chance of overlap.

The system of this invention further comprises the steps of transmitting a synchronization signal not corresponding to any of the signals of the succession and receiving the synchronization signal and in response thereto resetting the receiver to the signal following the one it is currently set to. This is done when the transmitter and receiver get out of step with each other. This can happen when the transmitter is actuated but for some reason the signal is not received. In this case the special synchronization code word makes the receiver reset itself to a predetermined code word of the succession or by advancing to the next word of the succession.

This is necessary if, for instance, the transmitter has been actuated while not aimed at the receiver. Similarly a normally not used code word that the receiver will always respond to can be generated, without fear of this signal being monitored since it will only be used in rare or emergency situations. This type of arrangement can be used when several different transmitters are used to operate a single receiver.

Thus according to this invention an auxiliary signal is transmitted that does not correspond to any of the signals of the succession and the transmitter is simultaneously reset to a predetermined one of the signals of the succession. The auxiliary signal is received and in response thereto the receiver is reset to the predetermined one of the signals of the succession.

It is also possible according to this feature of the invention to only reset the receiver to the predetermined one of the signals when it has just received a signal corresponding to one of the signals in the succession that is not the one the receiver is set to.

Thus the transmitter has an additional auxiliary encoder which can be actuated to produce an auxiliary code word which does not constitute a word of the acceptable progression. The receiver has an auxiliary decoder which converts the auxiliary code word into the unlocking signal when previously the receiver has received a code word that is of the acceptable succession but not the one the receiver is currently addressed to. In such a situation both the coder of the transmitter and the decoder of the receiver are reset, normally to the first word of the succession.

According to another feature of this invention the receiver has a plurality of channels capable of responding to respective successions of such coded signals and a plurality of transmitters generating the successions of the respective receiver channels are used. Thus each channel has its own succession of code words and is dedicated to a respective one of the transmitters. Thus each channel will be reset as the respective transmitter operates, but all of the different receiver channels will be connected to the same lock mechanism. With such an arrangement it would even possible to use the same succession of coded signals for each transmitter and receiver channel, but to precede each transmitted signal with a password that would direct the received signal to the channel for the transmitter that is on line.

In order to prevent someone from transmitting a succession of differently coded signals in the hope of eventually hitting on the right one, it is possible according to this invention to provide lockout means that shuts the entire system down for a short while, even if only a few seconds, after one or more false signals have been received, a false signal being one that corresponds to one of the predetermined succession but that is not the one the receiver is set to respond to at that time. This lockout means can also shut down the system completely and hold the lock closed even if within the predetermined interval the right signal is received. If the code succession has $10^6$ signals in it and the system shuts down for three seconds each time it receives a false signal, it will take more than 34 days to run through all possible combinations, an impossibly long time for any clandestine purpose. On the other hand a three-second delay is not critical for a user whose transmitter is incorrectly set so that he or she must use the above-described synchronization procedure. It is also possible to make the system freeze when it receives a false signal so that only a manual resetting or a remote-control setting via the synchronization signal can make it operational again.

It has been found to be particularly effective in a system having at least $10^6$ signals in the succession to only lock out the system when 100 false signals have been received within a predetermined time period. This represents only one chance in 10,000 of coming across the momentarily correct signal, and prevents the system from freezing when a false signal is generated wholly accidentally. In such an arrangement an alarm is sounded or otherwise made when the system does freeze.

It is also possible for the system to be self-synchronizing. In this arrangement whenever the system receives something that is very close to one of the signals it can accept, for instance within two bits, but that does not correspond to the signal the receiver is currently addressed to, the system resets not to that particular signal, but to the next one in the succession. Thus if the user actuates the transmitter and for some reason it has gotten out of step with the receiver or a bit of the signal is lost in transmission or reception, the system will respond correctly when the next transmission is made. In fact the system will be resynchronized. It is critical in such an arrangement that the progression in the succession not be too predictable, to prevent unauthorized resetting. Such an arrangement is particularly useful when several transmitters are used and the above-described multichannel system has been decided against. In fact in such an arrangement the transmitter can generate its signals at random, the key to the arrangement being the order of the signals in the succession.

DESCRIPTION OF THE DRAWING

The above and other features and advantages will become more readily apparent from the following, reference being made to the accompanying drawing whose sole figure is a schematic block diagram of the system of this invention.

SPECIFIC DESCRIPTION

As seen in the drawing, the system according to this invention has a transmitter 1 comprising a code-word generator and an auxiliary word generator that can be selectively operated by an actuator 8, normally a push-button, to produce a signal 3. The system is set so that normally it generates one of a sequence of multielement code words $S_1$–$S_n$. The words $S_1$–$S_n$ can have several bits apiece and form a succession of $10^6$ or more words, $n$ thus being equal to $10^6$. According to this invention the main code-word generator advances to the next code word each time it is actuated. Thus after generating signal $S_1$ it generates $S_2$, $S_3$, and so on to $S_n$, whereupon it returns to signal $S_1$ and steps through the sequence $S_1$–$S_n$ again.

A receiver 2 comprises a decoder which responds to and passes only one of the signals $S_1$ to $S_n$ at a time, and that advances to the next such word or signal each time it receives one. When the receiver is addressed to a given code word and this word is transmitted, it signals a controller 4 that operates a plurality of servomotors 6 via a switching unit 5. The servomotors 6 in this arrangement operate respective motor-vehicle door latches 7.

In addition the receiver 2 includes a 3-second cutout that completely shuts down the system for 3 sec each time a signal is received that corresponds to one of the code words $S_1$–$S_n$, but not the one currently being addressed by the receiver.

The transmitter 1 also has an auxiliary or synchronization-code generator. When the transmitter 1 and receiver 2 have gotten out of synchronization, this generator is operated to generate a specific code that does not correspond to any of the words $S_1$ to $S_n$. The receiver has an auxiliary decoder that can respond to this signal and can operate a reset unit that sets the main decoder of the receiver 2 back to signal $S_1$. Similarly, actuation of the auxiliary generator of the transmitter 1 sets the main generator of this transmitter back to signal $S_1$. These elements are only used occasionally, so clandestine discovery of the coding of the synchronization signal is unlikely, and would only be useful to one also knowing the code to which the unit is being reset.

It is also possible for the auxiliary decoder merely to set the main decoder of the receiver 2 to the next code in the sequence. This is done when the transmitter 1 has been accidentally actuated while out of range of the receiver 2 or when under other circumstances the transmitter 1 and receiver 2 have gotten slightly out of synchronization.

Of course the system of this invention can count in either direction in the succession. In fact the succession may be formed simply by somehow modifying a given signal, as by multiplying it by a predetermined factor, to produce the next in the succession and only resetting when the signal becomes too big to use conveniently.

The system of this invention, while operating in a relatively simple manner, makes unauthorized opening of the lock virtually impossible. Even a person who is able to analyze and reproduce a multiplicity of the unlocking signals will not be able to operate the lock, as the entire succession plus the place in the succession must both be known, an impossibly difficult task.

We claim:

1. A method of operating a remote-control lock system having:

a transmitter that can be set to emit any one of a succession of differetly coded signals;

a receiver that can be set to respond only to any one of the succession of signals; and a lock operable by the receiver only when same receives the signal it is set to, the method comprising the steps of:

initially setting the transmitter to emit a predetermined one of the succession of signals and setting the receiver to respond to the predetermined one of the signals; and thereafter, after each individual emission by the transmitter and reception by the receiver, automatically resetting the transmitter and receiver to the next of the signals in the succession except after the last signal of the succession has been emitted and received in which case the transmitter and receiver are automatically reset to the first of the succession of signals.

2. The remote-control lock-operating method defined in claim 1, further comprising the steps of:

transmitting a synchronization signal not corresponding to any of the signals of the succession; and receiving the synchronization signal and in response thereto resetting the receiver to the signal following the one it is currently set to.

3. The remote-control lock-operating method defined in claim 1, further comprising the steps of:

transmitting an auxiliary signal not corresponding to any of the signals of the succession and simultaneously resetting the transmitter to a predetermined one of the signals of the succession; and receiving the auxiliary signal and in response thereto resetting the receiver to the predetermined one of the signals of the succession.

4. The remote-control lock-operating method defined in claim 3 wherein the receiver is only reset to the predetermined one of the signals when it has just received a signal corresponding to one of the signals in the succession that is not the one the receiver is set to.

5. The remote-control lock-operating method defined in claim 1 wherein the receiver has a plurality of channels capable of responding to respective successions of such coded signals and a plurality of transmitters generating the successions of the respective receiver channels are used.

6. The remote-control lock-operating method defined in claim 1, further comprising the step of:

blocking the lock when the receiver receives a signal that is one of the signals of the succession but that is not the signal the receiver is set to.

* * * * *